US007137690B2

(12) United States Patent
Kawamura et al.

(10) Patent No.: US 7,137,690 B2
(45) Date of Patent: Nov. 21, 2006

(54) INTERCONNECT CIRCUIT

(75) Inventors: Naoto Kawamura, Corvallis, OR (US); Erik D. Ness, Vancouver, WA (US); William S. Eaton, Vancouver, WA (US); Charles R. Headrick, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 129 days.

(21) Appl. No.: 10/698,088

(22) Filed: Oct. 31, 2003

(65) Prior Publication Data

US 2005/0093942 A1 May 5, 2005

(51) Int. Cl.
*B41J 2/175* (2006.01)

(52) U.S. Cl. ..... 347/86

(58) Field of Classification Search ..... 346/140, 346/139; 347/50, 87, 20, 49, 5, 59; 400/175, 400/65

See application file for complete search history.

(56) References Cited

U.S. PATENT DOCUMENTS

| | | | | |
|---|---|---|---|---|
| 4,803,500 A | | 2/1989 | Milbrandt | 346/140 |
| 4,872,027 A | * | 10/1989 | Buskirk et al. | 347/19 |
| 5,363,134 A | * | 11/1994 | Barbehenn et al. | 347/49 |
| 5,411,343 A | * | 5/1995 | Childers | 400/692 |
| 5,461,405 A | | 10/1995 | Lehmann et al. | 347/49 |
| 5,528,269 A | * | 6/1996 | Drogo et al. | 347/19 |
| 5,706,040 A | | 1/1998 | Reid et al. | 347/50 |
| 5,742,306 A | | 4/1998 | Gompertz et al. | 347/48 |
| 5,831,649 A | | 11/1998 | Watrobski et al. | 347/19 |
| 5,904,507 A | | 5/1999 | Thomas | 348/131 |
| 6,030,075 A | | 2/2000 | Swanson et al. | |
| 6,170,939 B1 | * | 1/2001 | Ujita et al. | 347/86 |
| 6,174,046 B1 | | 1/2001 | Reid et al. | 347/50 |
| 6,435,662 B1 | * | 8/2002 | Kline et al. | 347/49 |
| 6,604,814 B1 | | 8/2003 | Browning et al. | 347/50 |
| 2003/0063157 A1 | | 4/2003 | Browning et al. | |
| 2003/0063158 A1 | | 4/2003 | Browning et al. | |

FOREIGN PATENT DOCUMENTS

| | | |
|---|---|---|
| EP | 0571093 | 11/1993 |
| EP | 0654958 | 5/1995 |
| WO PCT/US2004/034705 | | 3/2005 |

OTHER PUBLICATIONS

WO Search Report.

* cited by examiner

*Primary Examiner*—Shih-Wen Hsieh
(74) *Attorney, Agent, or Firm*—James R. McDaniel

(57) ABSTRACT

A print cartridge includes a cartridge body having a lower portion and a vertical wall. A printhead is coupled with the lower portion of the cartridge body. A contact array including a plurality of contact areas is disposed on the vertical wall. The contact array is one of at least two contact arrays. Each contact array has a different pattern of contact area locations. A portion of the contact areas of each contact array are capable of providing identity information for the print cartridge.

7 Claims, 12 Drawing Sheets

INTERCONNECT CIRCUIT

BACKGROUND

An inkjet printer forms a printed image by printing a pattern of individual dots at particular locations of an array defined for the printing medium. The locations may be visualized as being small dots in a rectilinear array. The locations are sometimes called "dot locations," "dot positions," or "pixels." Thus, a printing operation can be viewed as providing a pattern of dot locations with dots of ink.

Inkjet printers print pixels by ejecting drops of ink from ink ejecting nozzles onto the print medium and typically include a movable print carriage that supports one or more print cartridges. The print carriage traverses axially above the surface of the print medium, while the nozzles are controlled to eject drops of ink at appropriate times pursuant to command of a microcomputer or other controller. The timing of the application of the ink drops is intended to correspond to the pattern of pixels of the image being printed.

The particular ink ejection mechanism within the printhead may take on a variety of different forms known to those skilled in the art, such as those using thermal ejection or piezoelectric technology. For instance, two exemplary thermal ejection mechanisms are shown in commonly assigned U.S. Pat. Nos. 5,278,584 and 4,683,481. In a thermal ejection system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. When the heater elements are energized, an ink droplet is ejected from a nozzle associated with the heater element. By selectively energizing heater elements, ink drops are ejected onto the print medium in a pattern to form the desired image.

Certain inkjet printers employ replaceable print cartridges. The print cartridges and printers employ electrical interconnects between the cartridge and the printer, so that operation of the print cartridge can be controlled by the printer. The electrical interconnects can be in the form of an interconnect array having a plurality of discrete interconnect pads. The use of replaceable print cartridges in inkjet printers allows the possibility that a user may install or attempt to install a replacement print cartridge that is not designed for use with the user's particular printer or with the particular chute of the particular printer. The incorrect installation of a print cartridge in a printer can result in dangerous situations where electrical circuits are energized incorrectly, causing damage to the print cartridge, the printer, or both. This damage may cause substantially loss for users. Therefore, consideration must be given to the prevention of use of a print cartridge that will not operate properly in the chute or printer.

One solution to prevent incorrect use of a print cartridge in a printer is to make each print cartridge with a physically different shape from other print cartridges for other printers or chutes, so that there is no possibility of a printer accepting an incorrect cartridge. This solution requires very different production lines for print cartridges and printers and is consequently costly to implement. Another solution is to have similar print cartridges, but provide unique physical keys on the cartridge and printer so that an incorrect cartridge cannot be inserted into a printer. This solution can be defeated by a user who removes or modifies the physical keys. Yet another solution is to have physically similar print cartridges, and to make sure that the positions of the interconnect pads do not overlap between cartridges intended for different printers or different chutes. This solution becomes unreasonably difficult to implement, as eventually interconnect pad positions will overlap as the number of interconnect pads increases (increasing performance) and/or the size of the interconnect array decreases (decreasing cost).

SUMMARY

One aspect of the present invention provides a print cartridge. The print cartridge includes a cartridge body having a lower portion and a vertical wall. A printhead is coupled with the lower portion of the cartridge body. A contact array comprising a plurality of contact areas is disposed on the vertical wall. The contact array is one of at least two contact arrays. Each contact array has a different pattern of contact area locations. A portion of the contact areas of each contact array are capable of providing identity information for the print cartridge.

DETAILED DESCRIPTION

In the following Detailed Description, reference is made to the accompanying drawings which form a part hereof, and in which is shown by way of illustration particular embodiments in which the invention may be practiced. In this regard, directional terminology, such as "top," "bottom," "front," "back," "leading," "trailing," etc., is used with reference to the orientation of the Figure(s) being described.

Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
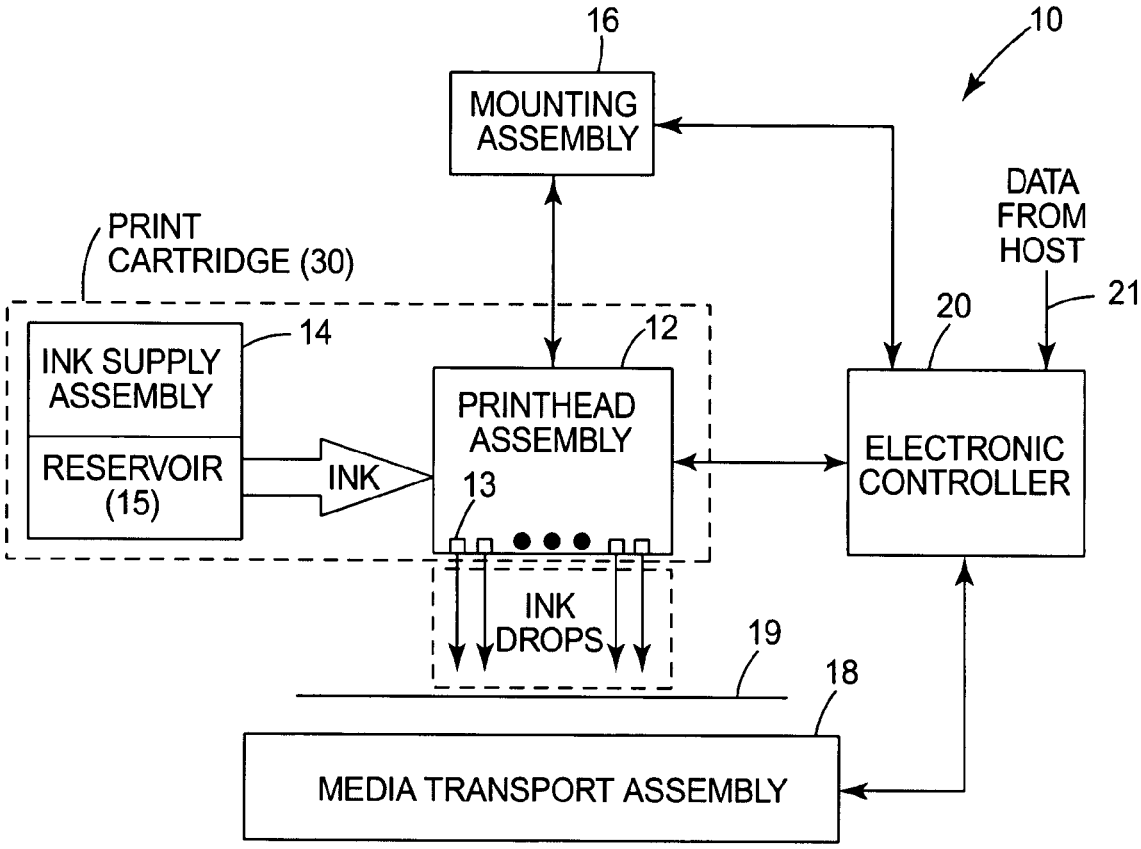
FIG. 1 is a block diagram illustrating one embodiment of an ink-jet printing system.

FIG. 1 illustrates one embodiment of an inkjet printing system 10. Ink-jet printing system 10 includes an inkjet printhead assembly 12 and an ink supply assembly 14. In the illustrated embodiment, inkjet printing system 10 also includes a mounting assembly 16, a media transport assembly 18, and an electronic controller 20.

Inkjet printhead assembly 12 includes one or more print heads which eject drops of ink or fluid through a plurality of orifices or nozzles 13. In one embodiment, the drops are directed toward a medium, such as print medium 19, so as to print onto print medium 19. Print medium 19 may be any type of suitable sheet material, such as paper, card stock, transparencies, Mylar, fabric, and the like. Typically, nozzles 13 are arranged in one or more columns or arrays such that properly sequenced ejection of ink from nozzles 13 causes, in one embodiment, characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, in one embodiment, ink flows from reservoir 15 to inkjet printhead assembly 12. In one embodiment, ink-jet printhead assembly 12 and ink supply assembly 14 are housed together in an inkjet or fluid jet cartridge or pen, also referred to as a print cartridge. In another embodiment, ink supply assembly 14 is separate from inkjet printhead assembly 12 and supplies ink to inkjet printhead assembly 12 through an interface connection, such as a supply tube (not shown).

Mounting assembly 16 positions inkjet printhead assembly 12 relative to media transport assembly 18, and media transport assembly 18 positions print medium 19 relative to inkjet printhead assembly 12. In one embodiment, ink-jet printhead assembly 12 is a scanning type printhead assembly and mounting assembly 16 includes a carriage (not shown) for moving inkjet printhead assembly 12 relative to media transport assembly 18. In another embodiment, inkjet printhead assembly 12 is a non-scanning type printhead assembly, e.g. a page wide printhead assembly, and mounting assembly 16 fixes inkjet printhead assembly 12 at a prescribed position relative to media transport assembly 18.

Electronic controller 20 communicates with inkjet printhead assembly 12, mounting assembly 16, and media transport assembly 18. Electronic controller 20 receives data 21 from a host system, such as a computer, and usually includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of ink-jet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops is determined by the print job commands and/or command parameters. In one embodiment, at least a portion of logic and drive circuitry forming a portion of electronic controller 20 is located on inkjet printhead assembly 12. In another embodiment, at least a portion of logic and drive circuitry is located off ink-jet printhead assembly 12.

Inkjet printing system 10 of FIG. 1 constitutes one embodiment of a fluid ejection system which includes a fluid ejection device. In other embodiments, inkjet printing system 10 can be a fluid ejection system that ejects any desired liquid onto a desired surface. Embodiments of fluid ejection devices used in fluid ejection systems include, but are not limited to, inkjet printheads, inkjet print cartridges or pens, fluid jet print cartridges or pens, fluid ejecting integrated circuits, and fluid ejecting nozzles.

Figure 2:
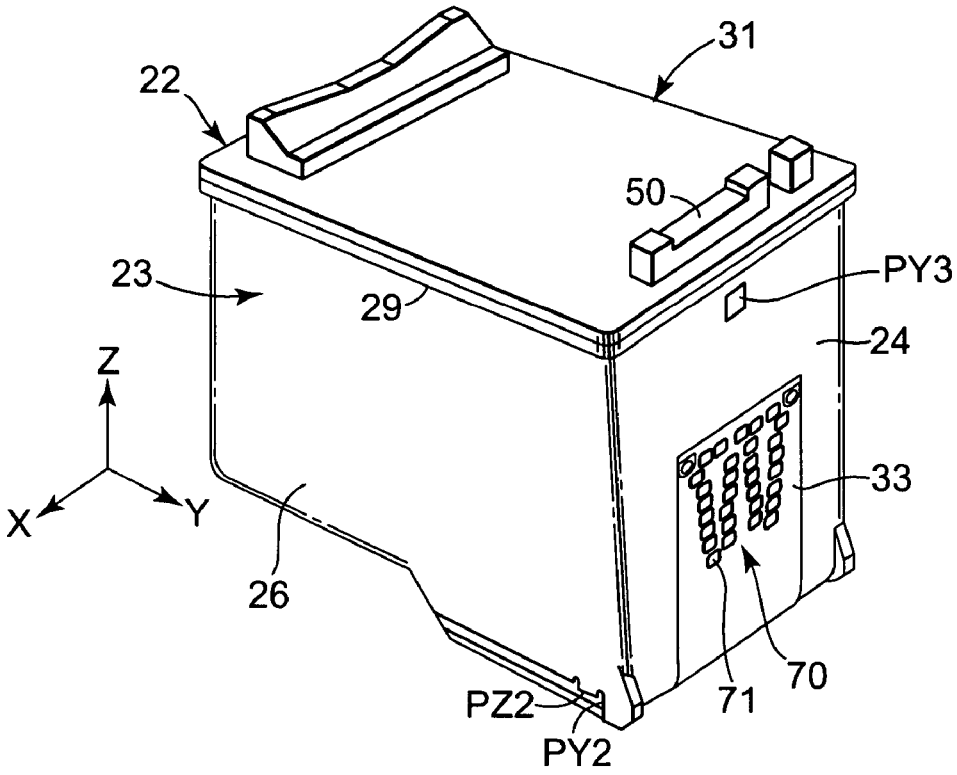
FIG. 2 is a schematic perspective view of an embodiment of an ink-jet print cartridge.
Figure 3:
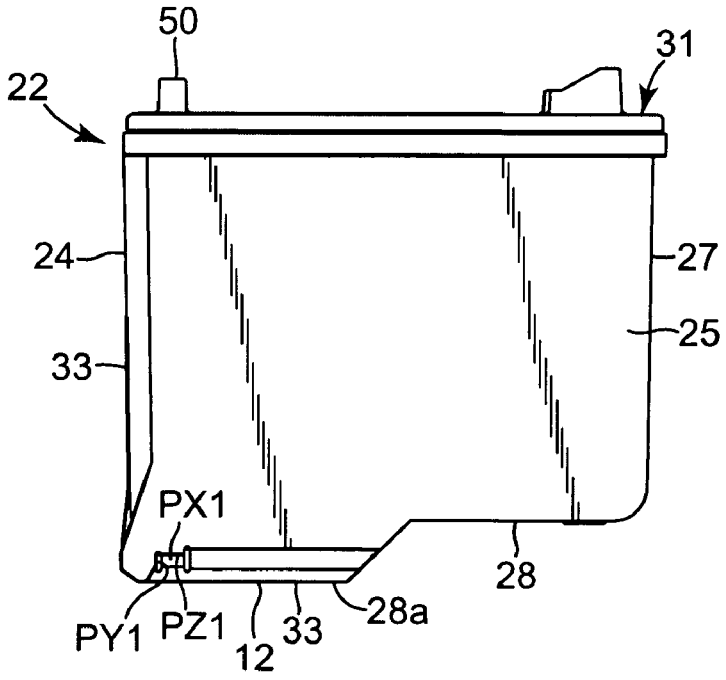
FIG. 3 is a schematic side elevational view of the embodiment of the inkjet print cartridge of FIG. 2.
Figure 4:
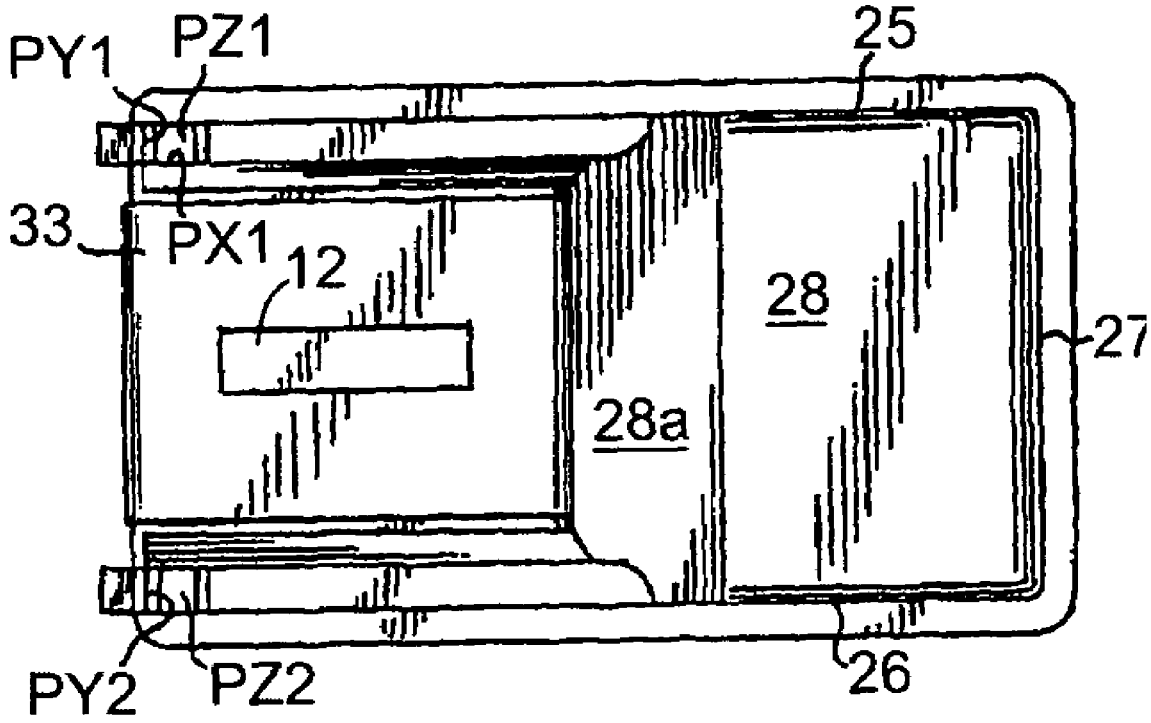
FIG. 4 is a schematic bottom plan view of the embodiment of the ink-jet print cartridge of FIG. 2.

FIGS. 2–4 illustrate one embodiment of a print cartridge 22. The print cartridge 22 includes a housing 23 that supports inkjet printhead assembly 12 and contains reservoir 15 of ink supply 14. As such, reservoir 15 communicates with inkjet printhead assembly 12 to supply ink to inkjet printhead assembly 12, as is well known in the art. Housing 23 is comprised of a rear wall 24, a left side wall 25, a right side wall 26, a front wall 27, and a bottom wall 28 that includes a snout section 28*a* that supports an inkjet printhead assembly 12. A top wall or lid 31 is attached to the upper edges of the front, side, and rear walls, and includes margins or lips 29 that extend beyond the front and side walls. A latch catch or feature 50 is disposed on the lid 31 close to the top boundary of the rear wall 24. The latch feature 50 extends upwardly from the top wall 31.

Other shapes may be utilized for housing 23, including, but not limited to, cubic, triangular, etc. Further, snout section 28*a* and lips 29 may be omitted depending on the design parameters.

Located in the vicinity of the intersection of the left side wall 25, rear wall 24 and snout 28*a* are a printhead cartridge X axis datum PX1, a first printhead cartridge Y axis datum PY1, and a first printhead cartridge Z axis datum PZ1. Located in the vicinity of the intersection of the right side wall 26, rear wall 24 and snout 28*a* are a second printhead cartridge Y axis datum PY2 and a second printhead cartridge Z axis datum PZ2. A third printhead cartridge Y axis datum PY3 is located in the upper portion of the rear wall 24. The print cartridge Y axis datums generally comprise lands that are configured to be generally orthogonal to the Y axis when the cartridge is installed in the mounting assembly 16. The print cartridge Z axis datums comprise lands that are configured to be generally orthogonal to the Z axis when the print cartridge is installed in the mounting assembly 16. The print cartridge X axis datum comprises land that is configured to be generally orthogonal to the X axis when the print cartridge is installed in the mounting assembly 16. As described further herein, the datums of the cartridge engage corresponding datums in the mounting assembly 16.

Other numbers, locations and combinations of datums may be utilized on cartridge 22, or datums may be omitted entirely, depending on the design parameters.

Disposed on the rear wall 24, but which can be located on one of the other walls depending on design parameters, is an electrical circuit 33 that provides electrical interconnection between the printer and the printhead 15. Electrical circuit 33 facilitates communication of electrical signals between electronic controller 20 and inkjet printhead assembly 12 for controlling and/or monitoring operation of inkjet printhead assembly 12. Electrical circuit 33 includes an array 70 of electrical contact areas 71 and a plurality of conductive paths 77 (best seen in FIGS. 5A and 6) that extend between and provide electrical connection between electrical contact areas 71 and bond pads 74 on the inkjet printhead assembly 12. As such, electrical contact areas 71 provide points for electrical connection with printing cartridge 22 and, more specifically, inkjet printhead assembly 12. In one embodiment according to the invention, electrical circuit 33 is a flexible electrical circuit, and conductive paths 77 are formed in one or more layers of a flexible base material. The base material may include, for example, a polyimide or other flexible polymer material (e.g., polyester, poly-methyl-methacrylate) and conductive paths 77 may be formed of copper, gold, or any other conductive material.

Figure 5A:
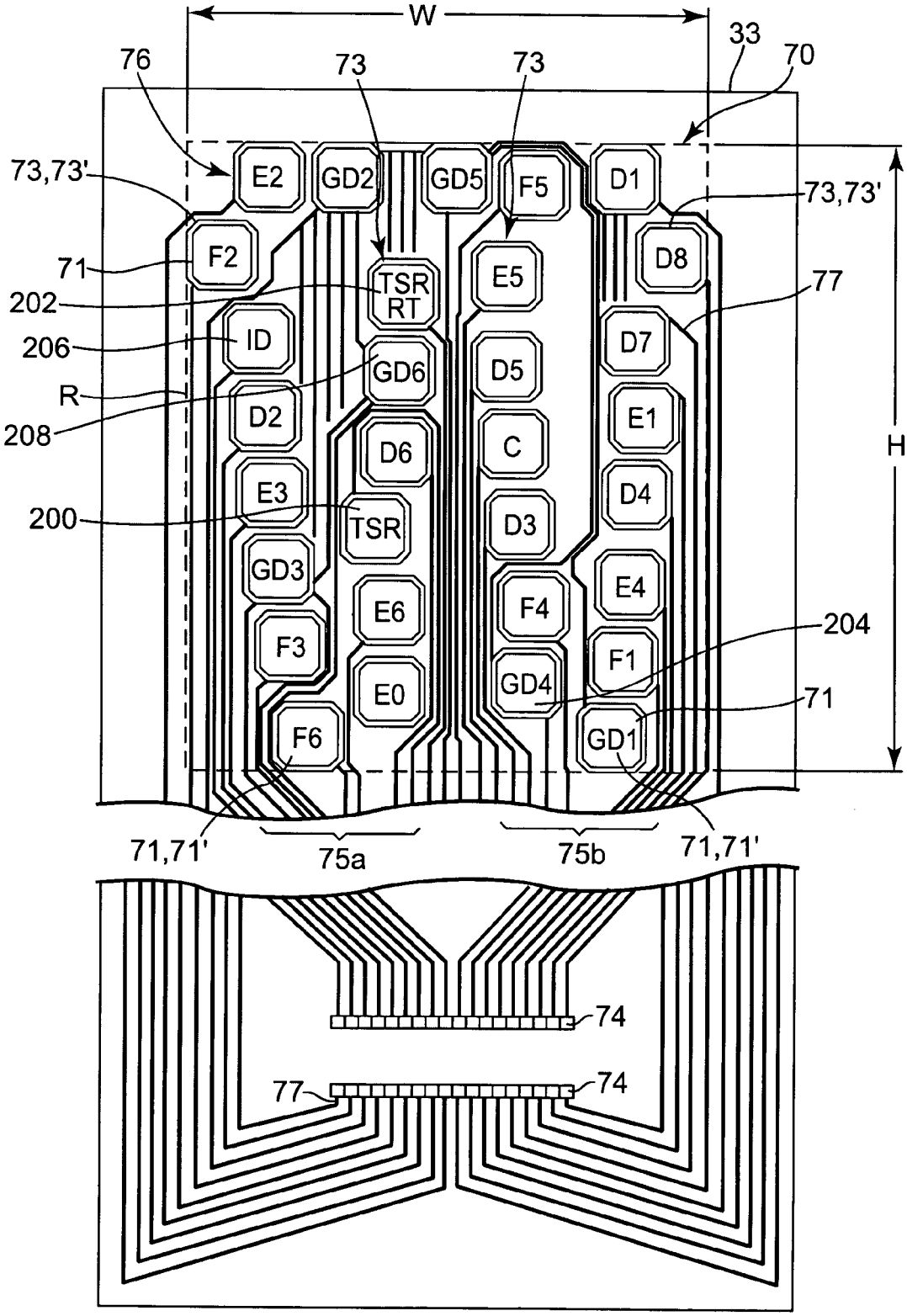
FIG. 5A is a schematic detail view of an embodiment of a flexible circuit of the inkjet print cartridge of FIG. 2.
Figure 9:
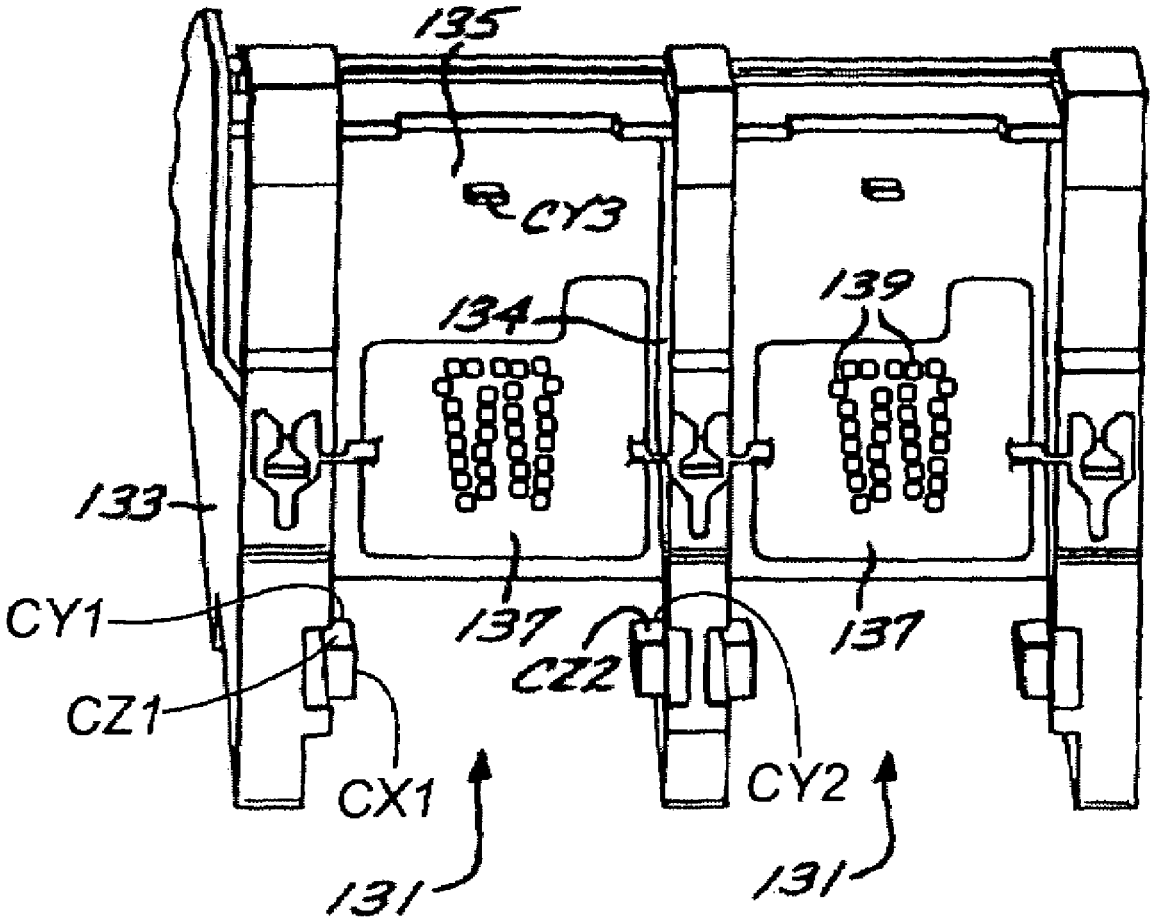
FIG. 9 is a schematic partial front perspective view of the embodiment of the print carriage of FIG. 7, with the cartridges and the latch assemblies removed.
Figure 10:
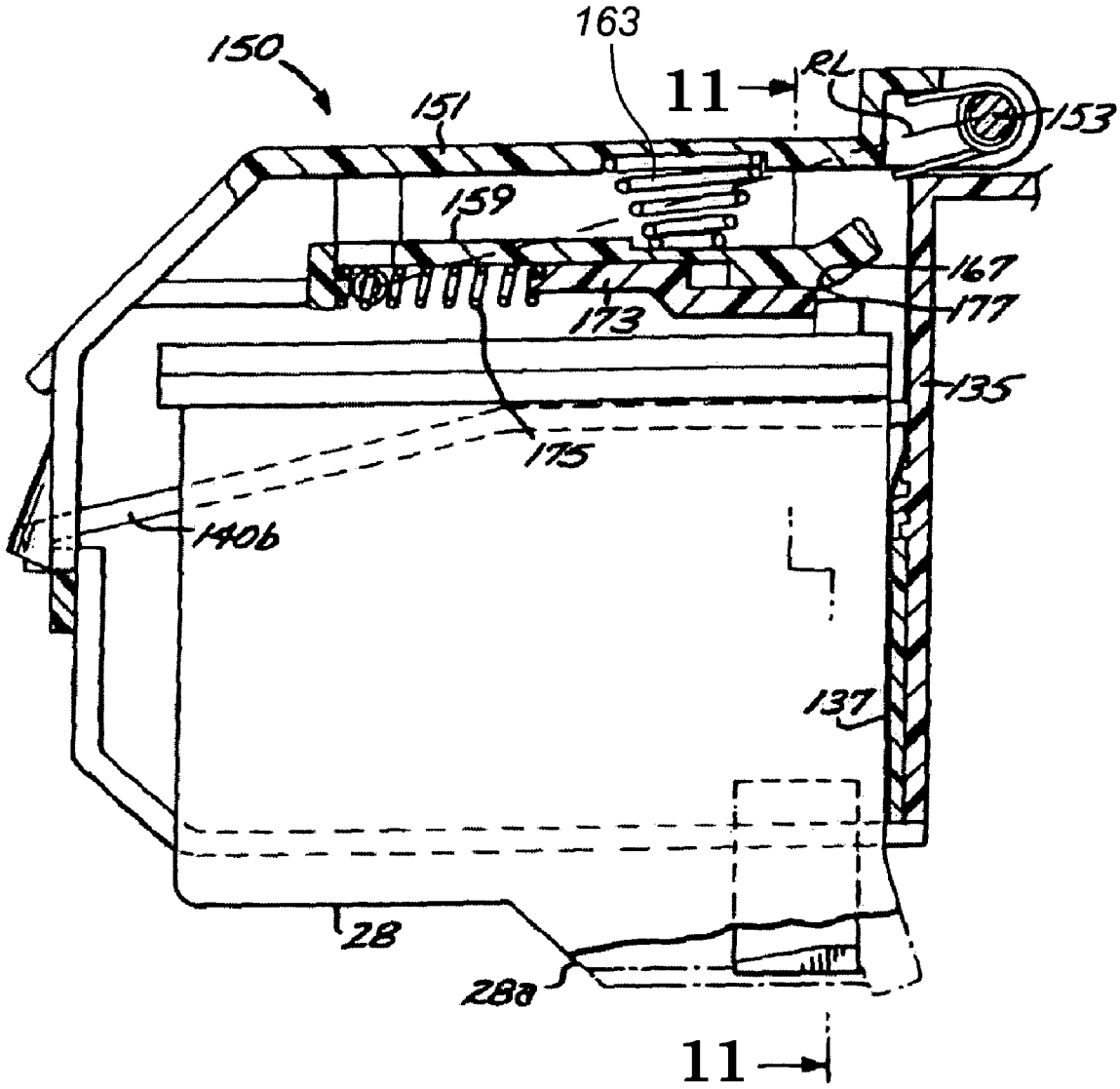
FIG. 10 is a schematic sectional elevational view of the embodiment of a chute and latch assembly of the print carriage of FIG. 7.
Figure 11:
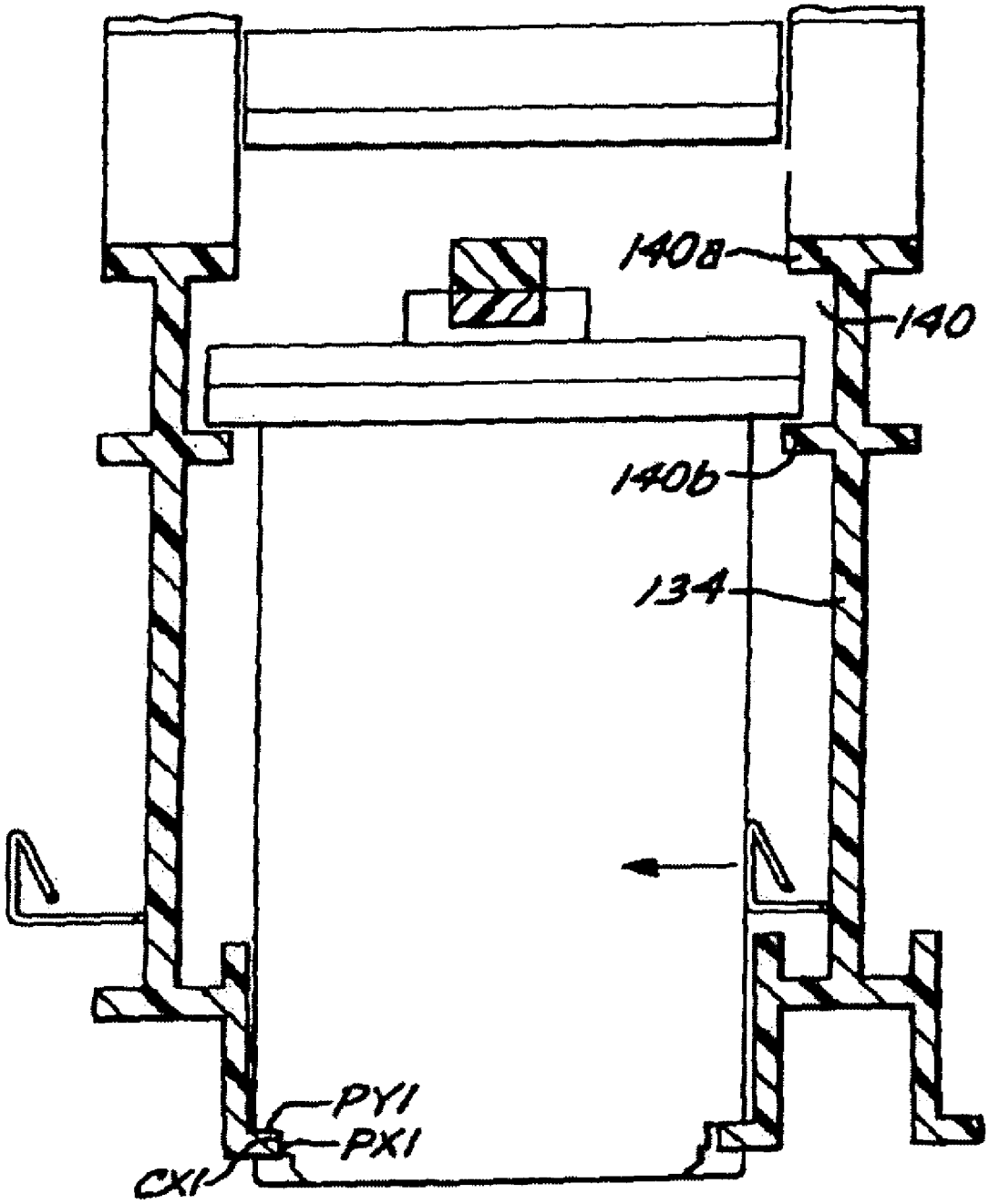
FIG. 11 is a schematic sectional elevational view of the embodiment of a chute of the print cartridge of FIG. 7.

FIG. 5A is a schematic depiction of an embodiment of the flexible circuit 33. Contact areas 71 are contactively engagable from the near side of the flexible circuit 33 which is the side that is away from the cartridge body. The side of the flexible circuit 33 that is against the cartridge body is called the far side. The contact areas 71 are disposed on a portion of the flexible circuit 33 that is located on the rear wall 24, and comprise electrically conductive areas that are contactively engageable with corresponding contact bumps 139 on a resilient contact circuit 137 (FIG. 9) located in the mounting assembly 16 (FIG. 1). In the embodiment depicted in FIG. 5A, the flexible circuit 33 is formed of a flexible substrate on one side thereof and includes openings so that portions of the conductive pattern can be contacted from the other side of flexible circuit 33. In such implementation, the contact areas 71 comprise conductive areas exposed by openings in the flexible substrate. The contact areas 71 can be circular, octagonal, square, square with rounded or beveled corners, or any other shape or geometry.

In the exemplary embodiment of FIG. 5A, the contact areas 71 are more particularly arranged in a plurality of adjacent, transversely separated columnar arrays 73 of contact areas 71. Each columnar array 73 includes a lower contact area 71' that is closest to the bottom wall 28 of the print cartridge 22. By way of illustrative example, one or more of the columnar arrays 73 can be substantially nonlinear. The substantially nonlinear arrangement of contact areas 71 within columnar arrays 73 allows the positioning of contact areas 71 to provide space where it is needed for conductive paths 77 to pass by where space is limited. The columnar arrays 73 are arranged in side by side pairs or groups 75*a*, 75*b* of columnar arrays 73. As shown in FIG. 5A, there can be two pairs 75*a*, 75*b* of columnar arrays 73 so as to have four columnar arrays 73 of contact areas 71. The columnar arrays 73 of each pair 75*a*, 75*b* are arranged to converge toward each other in the direction toward the bottom wall 28 of the cartridge 22.

The contact array 70 further includes a horizontal row 76 of contact areas 71 substantially perpendicular to the columnar arrays 73. Row 76 is positioned adjacent the top of contact array 70. The horizontal row 76 makes efficient use of space within contact array 70, thereby reducing the number of required columnar arrays 73 and allowing the array 70 to be narrower. Other array shapes and structure different that those depicted herein may be utilized in the present embodiments.

The outermost transversely separated columnar arrays designated 73' can have more contact areas 71 than the columnar arrays 73 between such outermost transversely separated columnar arrays 73'. By way of example, each outermost columnar array 73' may include at least seven contact areas 71, and each of the other columnar arrays 73 may include at least six contact areas 71. Additionally, the outermost transversely separated columnar arrays 73' may have fewer or the same number of contact areas 71 as columnar arrays 73.

The spacing between contact areas 71 is asymmetric, which allows a reduction of the size of array 70, as compared to symmetric spacing. When the cartridge 22 is used in a printer, the flexible circuit 33 of cartridge 22 mates with resilient contact circuit 137 (FIG. 9) of the printer. The resilient contact circuit 137 has design constraints for spacing between contact bumps 139, as well as spacing between contact bumps 139 and conductive paths. The resilient contact circuit 137 may route the conductive paths (not shown) away from the contact bump 139 array in the opposite direction from the direction that the conductive paths 77 are routed. Many of the conductive paths on both flexible circuit 33 and resilient contact circuit 137 are routed between contact areas 71 and contact bumps 139, respectively. In instances where this is done, the contact areas 71 and contact bumps 139 may be spaced farther apart from each other. However, when there is not a conductive path between adjacent contact areas 71 or adjacent contact bumps 139, the contact areas 71 and contact bumps 139 can be spaced closer together. By utilizing asymmetric pad spacing, columnar arrays 73 can be shorter than a columnar array with symmetric spacing, since space is not wasted when conductive paths are not routed between contact areas 71 on flexible circuit 33, or between contact bumps 139 on the resilient contact circuit 137 of the printer.

Figure 5B:
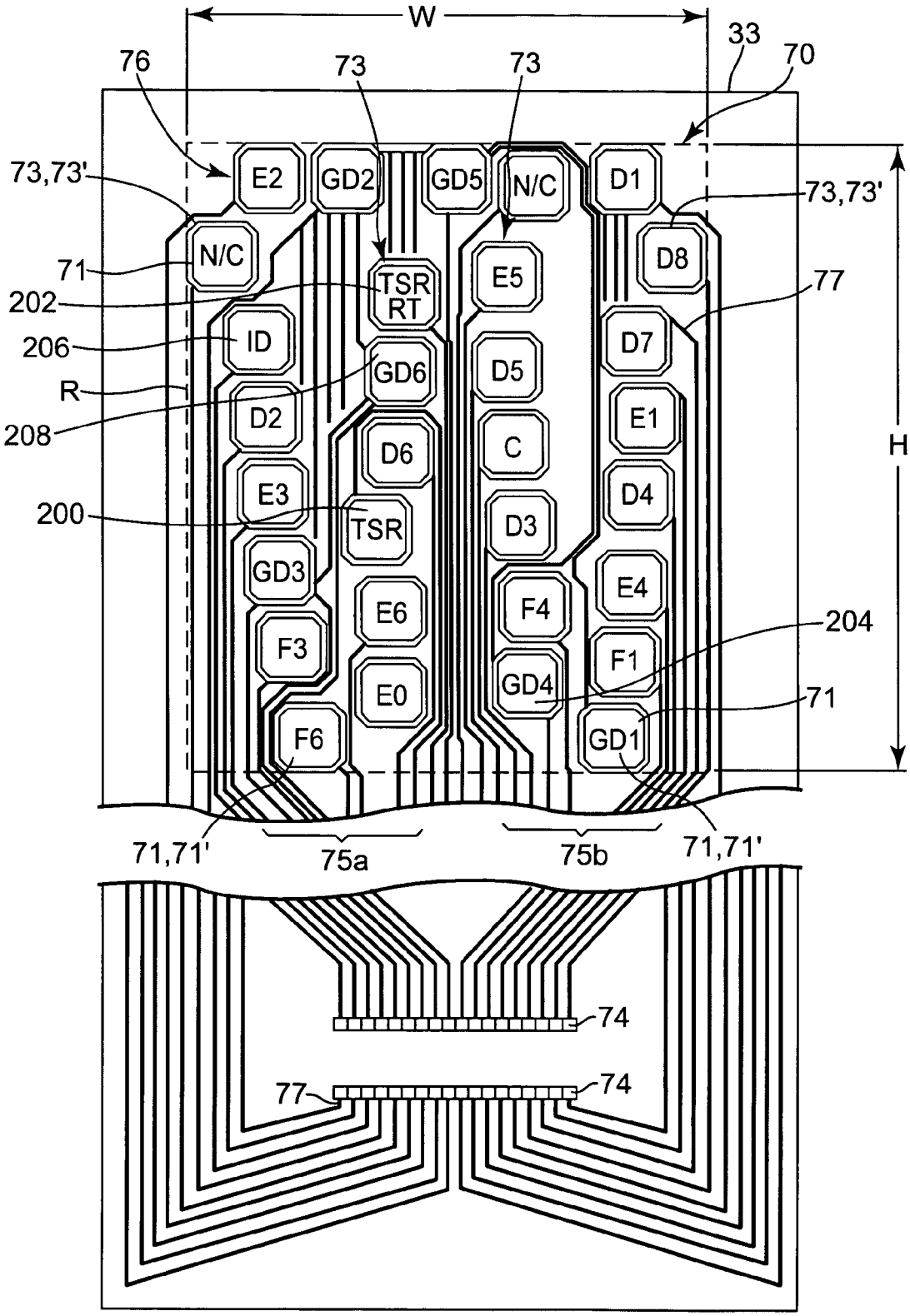
FIG. 5B is a schematic detail view of another embodiment of a flexible circuit of the inkjet print cartridge of FIG. 2.
Figure 6:
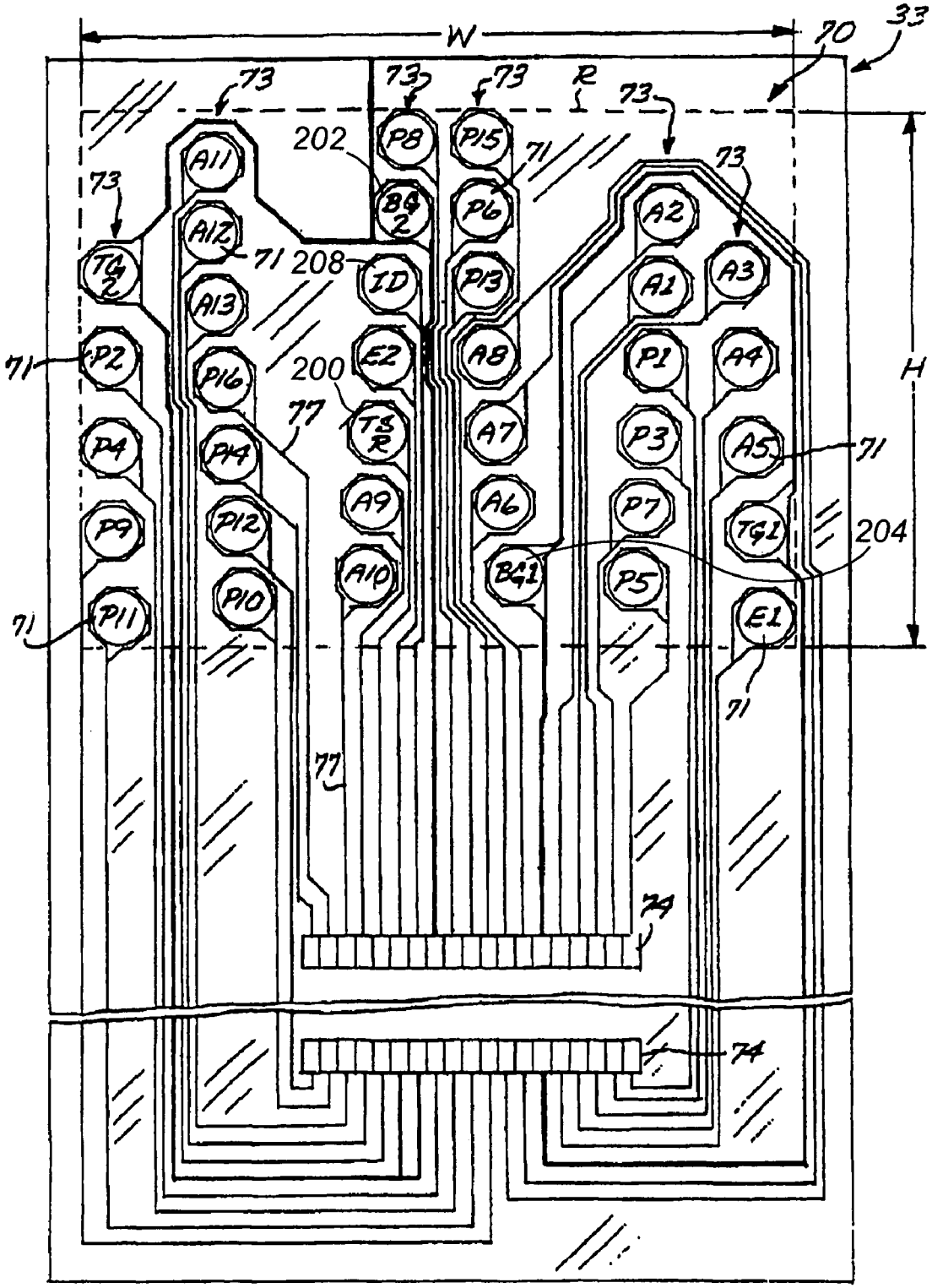
FIG. 6 is a schematic detail view of yet another embodiment of a flexible circuit of the inkjet print cartridge of FIG. 2.
Figure 7:
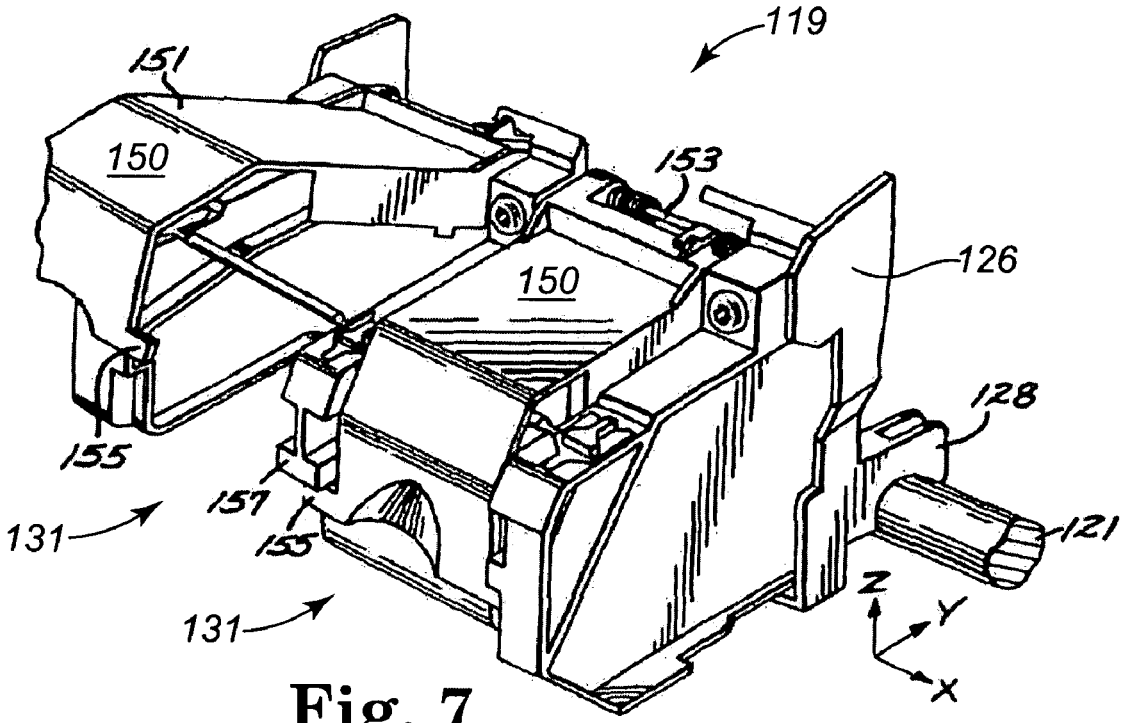
FIG. 7 is a schematic perspective view of an embodiment of a print carriage used in the mounting assembly of FIG. 1.
Figure 8:
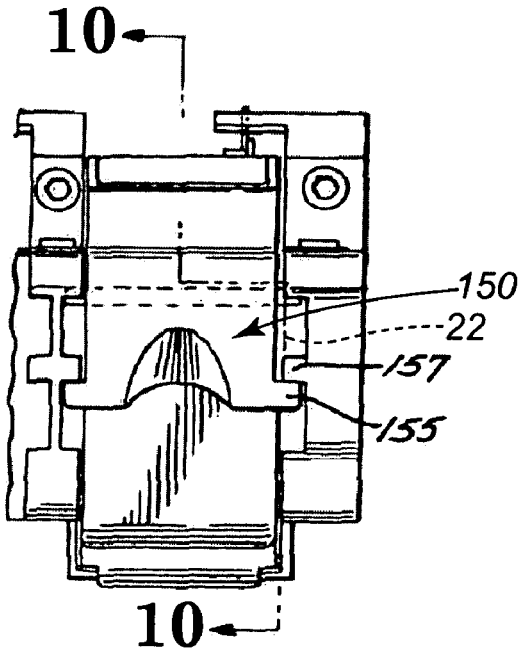
FIG. 8 is a schematic front elevational view of an embodiment of a chute and latch of the print carriage of FIG. 7.

In one embodiment according to the invention, where nonlinear arrays 73, asymmetric spacing of contact areas 71, and horizontal row 76 of contact areas 71 are utilized, as illustrated in FIGS. 5A and 5B, the overall array 70 area is approximately 13.7 mm×11.3 mm. An equivalent array using linear, evenly spaced contact areas 71, as illustrated in FIG. 6, measures about 13.7 mm×12.2 mm. The approximately 1 mm reduction in the width W of the array allows the flexible circuit 33 to be laid out in 3 pitches (4.75 mm per pitch) of a 48 mm flexible circuit, as opposed to 4 pitches. This alone results in a savings of approximately 25% of the area for the array 70.

In the embodiment of FIGS. 5A and 5B, less than one half of the contact areas 71 are positioned in the lower half of the smallest rectangle R, and columnar arrays 73 extend across at least one half of the height of the smallest rectangle R. By way of example, for the contact array 70 depicted in FIG. 5A, the smallest rectangle R has a height in the range of about 13.7 mm and a width W in the range of about 11.3 mm. Specifically, the rectangle R has a width of less than about 12 mm. The contact areas 71 of the columnar arrays 73 can be spaced center to center from each other by distances of less than 1 mm, about 1 mm to 3 mm, and greater than 3 mm. Depending upon implementation, some or all of the contact areas 71 may be electrically connected to the ink-jet printhead assembly 12 by the conductive traces generally indicated by the reference designation 77. The conductive traces are preferably disposed on the far side of the flexible circuit 33, which is the side against the cartridge housing, and lead to bond pads 74 on the inkjet printhead assembly 12 (FIGS. 5A and 5B).

In the exemplary embodiment of FIG. 5A, the contact areas 71 include enable line contact areas E1–E6 configured to receive signals which enable energizing of heater elements; data line contact areas D1–D8 configured to receive signals which provide print data representative of an image to be printed; fire line contact areas F1–F6 configured to receive timed energy pulses employed to heat ink to be ejected from heater elements; ground line contact areas GD1–GD6; a control signal contact area C configured to receive a signal for controlling the internal operation of the printhead; a temperature sense resistor contact area TSR, a temperature sense resistor return contact area TSR-RT, and an identification bit contact area ID.

In an illustrative embodiment, all of the ground contact areas GD1–GD6 are interconnected by ground traces 79 that are on the flexible circuit 33. Such ground traces 77 can more particularly be located close to the columnar arrays 73 so as to be only on the portion of the flexible circuit that is on the rear-wall of the print cartridge body.

FIG. 5B shows a contact array 70 similar to that in FIG. 5A, but wherein two contact areas 71 labeled NC are not used.

FIG. 6 shows another flexible circuit 33 having a contact array 70 with a different arrangement of contact areas 71 from that illustrated in FIGS. 5A and 5B. The exemplary embodiment of FIG. 6 is described in detail in U.S. Pat. No. 6,604,814, commonly assigned or under a duty of common assignment herewith. U.S. Pat. No. 6,604,814 is fully incorporated herein by reference in its entirety.

In the exemplary embodiment of FIG. 6, contact areas 71 are arranged in a plurality of side by side transversely separated columnar arrays 73 of contact areas 71. The columnar arrays 73 can be substantially linear. The six columnar arrays 73 of FIG. 6 are arranged in three side by side pairs or groups of columnar arrays. Each pair of columnar arrays includes two columnar arrays 73 that diverge from each other in the direction toward the bottom wall of the cartridge. Each columnar array 73 spans at least 70% if the height H of the smallest rectangle R that encloses the array of contact areas 71 and defines a region occupied b the contact areas 71. By way of example, for the exemplary embodiment of FIG. 6, the smallest rectangle R has a height H in the range of about 10 to 14 millimeters and a width W in the range of about 15 to 18 millimeters. The height to width ratio can be in a range of about 0.6 to 0.9 Contact areas 71 include primitive select contact areas P1–P16, address signal contact areas A1–A13, enable signal contact areas E1–E2, a temperature sense resistor contact area TSR, an identification bit contact area ID, and ground line contact areas TG1, TG2, BG1, and BG2.

Referring now to FIGS. 7–11, one embodiment of a portion of mounting assembly 16 is illustrated. Mounting assembly 16 includes a print carriage 119 having a base 126 that supports the structure, and two bearings 128 located at the ends of the base 126. Bearings 128 slidably support the print carriage 119 on slider rod 121. The print carriage 119 further includes two chutes 131 that each receive, hold, and align an inkjet print cartridge 22. Both chutes 131 are constructed and operate similarly. Each chute includes a rear wall 135 that comprises, for example, a portion of the base 126, a left side wall 133 that extends from the rear wall 135, and a right side wall 134 that extends from the rear wall 135 and is generally parallel to the left side wall 133.

It should be noted that other configurations and mechanical components may be used or included as part of mounting assembly 16. The configuration and mechanical components of mounting assembly 16 as described herein are designed for the embodiment of the fluid ejecting device illustrated in FIGS. 2–4. However, the configuration and mechanical components of mounting assembly 16 will vary according to the design of both the fluid ejection system and the fluid ejection device used therewith.

Carriage datums CY1, CZ1 and CX1, formed for example as part of the base 126, are located at the bottom of the chute 131 in the vicinity of the intersection of the left side wall 133 the rear wall 135, while carriage datums CY2 and CZ2 for example as part of the base 126 are located at the bottom of the chute 131 in the vicinity of the intersection of the right side wall 134 and the rear wall 135. A carriage datum CY3 is located on the rear wall 135.

A resilient contact circuit 137 is located on the rear wall 135 of the chute and contains electrical contact bumps 139 that are urged against corresponding contact areas 71 on the flex circuit 33 of the print cartridge 22. The contact bumps 139 are arranged in a pattern having a mirror image of the pattern of contact areas 71 of a print cartridge 22 intended for use with the printer. The resilient contact circuit 137 further functions as a resilient element that urges the print cartridge PY1, PY2 against carriage datums CY1, CY2 when the print cartridge 22 is installed. By way of illustrative example, the resilient contact circuit 137 comprises a flexible circuit and resilient pad located between the flexible circuit and the rear wall 135.

Located in each side wall 133, 134 is shaped guide channel 140. The guide channels 140 engage lips 29 of the lid 31 of the print cartridge 22, and guide the cartridge at an appropriate elevation and pitch (or rotation) of the cartridge about the X axis as the cartridge is inserted, so as to guide the cartridge into the general vicinity of the carriage datums. By way of illustrative example, each guide channel comprise upper and lower rails 140*a*, 140*b* or *a* recessed slot having appropriate sides.

Located at the top of each chute 131 is a hinged latch assembly 150 (FIG. 7 and FIG. 10) that includes a latch support arm 151 that is pivotally attached by a hinge 153 to the top of the rear wall 135 so as to be rotatable about a hinge axis that is parallel to the X-axis. Latch hooks 155 are provided for engaging latch tabs 157 disposed at the front of the side walls 133, 134.

A pivoting biased clamp lever 159 is pivotally attached to the lower side of the latch arm 151 so as to be pivotable about an axis that is parallel to the X axis. The clamp lever 159 extends generally toward the chute rear wall 135 when the latch is closed. The clamp lever 159 is biased by a spring 163 to pivot away from the latch arm 151. A land 167 is disposed at the distal portion of the pivoting clamp 159 for pushing down on the top portion of the latch feature 50 of the print cartridge 22.

The pivoting clamp lever 159 further includes a sliding clamp 173 slidably located for movement generally orthogonally to the pivoting clamp hinge axis. The sliding clamp 173 is biased by a spring 175 to slide along the pivoting clamp lever 159 away. A sliding clamp land 177 is disposed at the distal end of the sliding clamp 173 adjacent the pivoting clamp land 167.

In one embodiment, the cartridge 22 is inserted generally horizontally into the chute 131. The guide channels 140 control the elevation and the pitch about the X axis of the cartridge 22 as it is inserted into the chute 131, such that print cartridge datums PY1, PY2 move over the corresponding carriage datums CY1, CY2. The latch arm 151 is then pivoted downwardly which causes the sliding clamp land 177 and the pivoting clamp land 167 to eventually engage the latch feature 50 on the top of the cartridge. Continued displacement of the latch arm 151 causes the sliding clamp 173 to resiliently push on the latch feature 50 generally along the Y axis, and further causes the pivoting clamp lever 159 to push on the latch feature 50 generally along the Z axis. The push generally along the Y axis is independent of the push generally along the Z axis. The push along the Z axis causes the print cartridge datums PZ1, PZ2 to snugly seat against the carriage datums CZ1, CZ2. The push along the Y axis causes the print cartridge to pivot about the X axis so that the print cartridge datum PY3 snugly seats against the carriage datum CY3. The resilient contact circuit 137 is located so as to cause the print cartridge datums PY1, PY2 to seat snugly against the carriage datum CY1, CY2 when the print cartridge datums PZ1, PZ2 are engaged with the carriage datums CZ1, CZ2, and the print cartridge datum PY3 is engaged with the carriage datum CY3.

Other methods and arrangements for inserting print cartridge 22 into assembly 16 may be utilized, depending on the design of both parts. Further, other designs of chutes may be utilized depending on design parameters of print cartridge 22 or vice-versa.

Referring again to FIGS. 5A, 5B and 6, it can be seen that the arrays 70 of the exemplary embodiments and the contact areas 71 therein are different in their layouts. Differences include but are not limited to the pattern formed by contact areas 71, the spacing between contact areas 71, the overall size of the arrays 70, the number of contact areas 71 within the array, the functions of the contact areas 71, and the location of specific contact areas 71 within the array, to name a few, either individually or in combination. There are also some similarities between the contact arrays 70. Similarities include but are not limited to the function of some contact areas 71 (for example, ground contact areas, temperature sense resistor contact areas, and identification bit contact areas), and the position of some specific contact areas 71 within the array. In other alternate embodiments according to the invention, the various contact areas 71 described with respect to the exemplary embodiments may be arranged in different patterns, spacing, shapes, sizes, functions and numbers than the exemplary illustrated embodiments.

Print cartridges of different families (intended for use in different printers, groups of printers, or different chutes within the same or different printers) may have similar or identical physical shapes (that is, the housings 23 may be substantially the same shape) and therefore be capable of insertion into a variety of different printers. However, print cartridges of different families may also have different layouts of contact areas 71 on flexible circuit 33. For example, a print cartridge intended for use in a first chute may have a contact array 70 like that illustrated in FIG. 6, while a print cartridge intended for use in a second chute may have a contact array 70 like that illustrated in FIG. 5A. The contact bumps 139 of each chute will be configured for complete and proper electrical engagement with only print cartridges that are to be operated by the printer in the particular chute. The printer may therefore be capable of determining if a correct print cartridge (that is, a print cartridge that is to operate in the particular chute) is installed prior to attempting to print, so that damage to the printer, print cartridge, or both, can be avoided.

For the controller 20 of the printer to distinguish whether a print cartridge, which is operable in the particular chute, has been installed a continuity and diagnostics test is conducted. In some embodiments, the continuity and diagnostics test is performed using lower currents, voltages, and/or powers than those required for operation, e.g. energizing of the heater elements, of a print cartridge in the chute.

The ability to perform continuity and diagnostics testing may be assured by designating one or more selected contact areas 71, which are to be used for continuity and diagnostic testing, to specific positions within array 70 for all print cartridges. In this manner, for any print cartridge inserted into any chute of any printer, one or more selected contact areas 71 of the print cartridge will be in electrical contact with a corresponding contact bump 139 of the printer, regardless of the printer type. If the print cartridge is identified as being operable in the particular chute, printing can proceed. If the print cartridge is identified as not being operable in the particular chute, printing may be prohibited until the correct print cartridge is inserted into the printer. One method of determining whether the print cartridge inserted is identified as the correct print cartridge involves, continuity and diagnostic testing as described herein.

The contact arrays 70 of FIGS. 5A and 6 provide examples of contact area 71 layouts that permit a printer to conduct continuity and diagnostics testing of print cartridges. In examining the contact arrays of FIGS. 5A and 6, it can be seen that several contact areas 71 are similarly positioned or located within their respective array 70, such that when the arrays 70 are overlaid on each other, the similarly positioned or located contact areas 71 are superimposed. The contact areas 71 that are similarly positioned or located within their respective array may be said to be commonly positioned or located. The contact areas 71 that are not commonly positioned or located may be said to be uniquely positioned or located within their respective array 70. In the illustrated example, the TSR contact area of FIG. 5A overlays the TSR contact area of FIG. 6 (contact area position 200); the TSR-RT contact area of FIG. 5A overlays a ground contact area of FIG. 6 (contact area position 202); a ground contact area of FIG. 5A overlays a ground contact area of FIG. 6 (contact area position 204); the ID contact area of FIG. 5A overlays no contact areas of FIG. 6 (contact area position 206); and a ground contact area of FIG. 5A overlays the ID contact area of FIG. 6 (contact area position 208). Thus, in the illustrated example, the contact areas 71 in contact area positions 200, 202, 204, 208 may be said to be said to be commonly positioned or located. All other contact areas 71 may be said to be uniquely positioned or located.

Using the exemplary contact arrays 70 of FIGS. 5A and 6 as an example, a chute may be configured to operably print using a first print cartridge having a contact array 70 like that illustrated in FIG. 5A. The chute may also be configured when to be inoperably when it receives a second print cartridge having a contact array 70 like that illustrated in FIG. 6. The controller 20 of the printer may be capable of detecting and rejecting a print cartridge having a contact array 70 like that illustrated in FIG. 6. Using the contact array layouts of FIGS. 5A and 6, the exemplary printer is able to read a value on the thermal sense resistor of an installed print cartridge of either type (because the TSR contact area of FIG. 5A overlays the TSR contact area of FIG. 6 at contact area position 200). However, the exemplary printer is unable to read the ID bit of a print cartridge using a contact array like that of FIG. 6 (because the ID contact area of FIG. 5A overlays no contact areas of FIG. 6 at contact area position 206). Using this information, the exemplary printer knows that a print cartridge is installed (because otherwise it could not read the value of the thermal sense resistor), and it also knows that the cartridge is a cartridge that is not be operated in the particular chute (because no ID bits are readable). This information allows the exemplary printer to prevent operation of the print cartridge, and thereby prevent potential damage to the printer and/or print cartridge.

Other alignments and configurations of one or more particular contact bumps and contact areas may be used to identify specific print cartridge than those described above.

Figure 12:
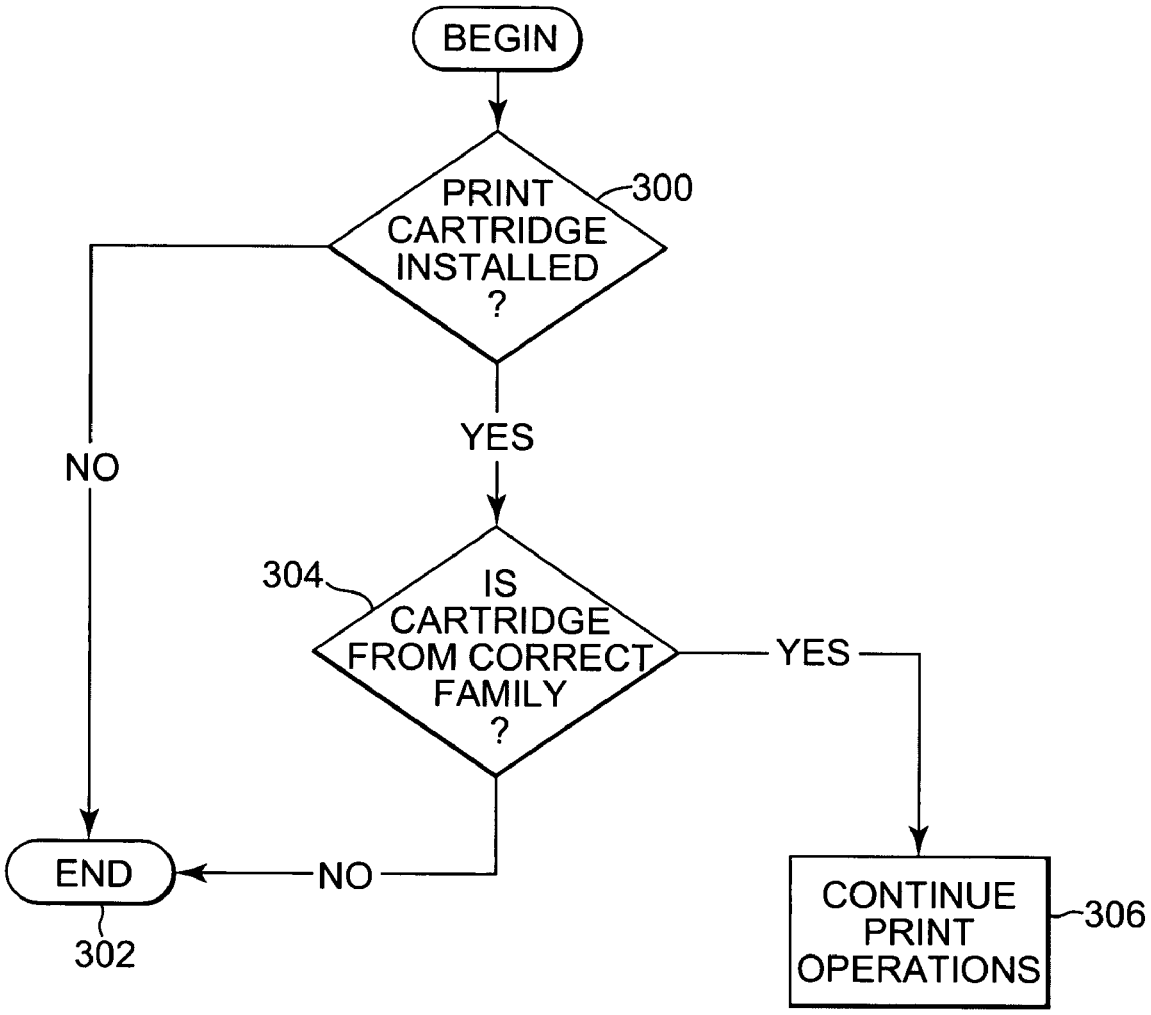
FIG. 12 is a flowchart of an embodiment of a method for detecting an incorrect print cartridge according to the invention.

Referring to the flowchart of FIG. 12, the printer controller 20 first attempts to determine whether a print cartridge is installed in the chute (box 300). If no print cartridge is detected, printing operations end (box 302). If controller 20 determines that a print cartridge is installed in the chute of the printer, the controller 20 attempts to determine if the installed print cartridge is to be operated from the chute into which it was installed (box 304). If a cartridge is not to be operated from the chute in which the cartridge is installed, then the printer is prevented from printing (box 302). If the cartridge is to be operated from the chute in which the cartridge is installed, then the printer is allowed to print (box 306).

Figure 13:
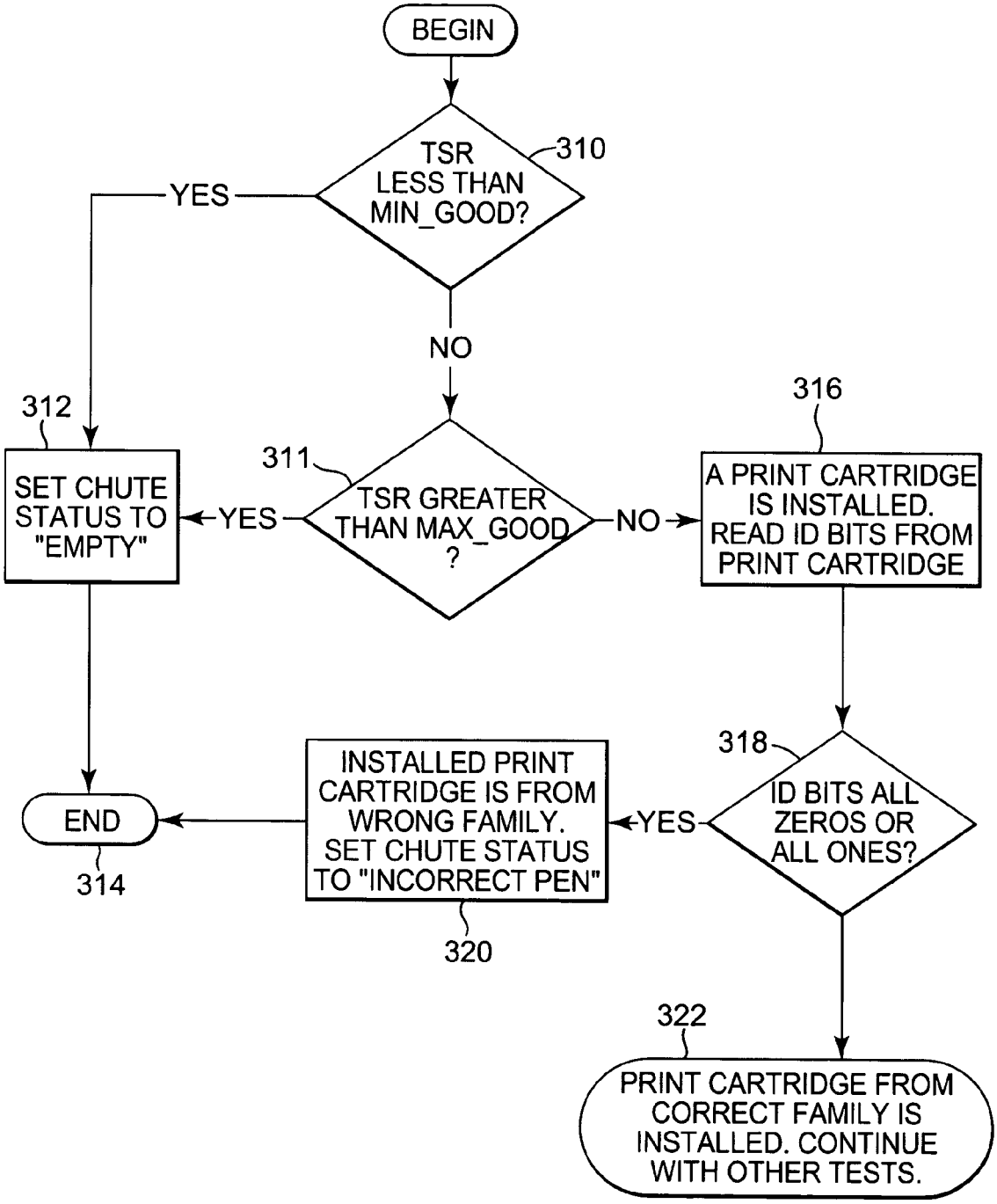
FIG. 13 is a flowchart of an embodiment of the method of FIG. 12, using the flexible circuit implementations of FIGS. 5A and 6.

Referring to the flowchart of FIG. 13, the method of FIG. 12 is illustrated using the exemplary contact arrays 70 of FIGS. 5A and 6. First, to determine whether a print cartridge is installed in the chute, the controller 20 attempts to read a value of a thermal sense resistor on a print cartridge. If the controller 20 is unable to obtain a thermal sense resistor value, or if the value of the thermal sense resistor falls outside of a specified range (for example, falling below a minimum value (box 310) or exceeding a maximum value (box 311)), then the controller 20 determines that no print cartridge is installed in the chute 131 of the printer, the chute status is set to "empty" (box 312), and printing operations end (box 314). If the thermal sense resistor value falls within the specified range, the controller 20 determines that a print cartridge is installed in the chute and attempts to read the print cartridge ID bit from the installed print cartridge (box 316). If the ID bit returns an unsatisfactory value (box 318), such as a binary value of all zeros or all ones), the controller 20 identifies the print cartridge as being from the wrong family (a print cartridge that is not operable in the chute in which it is installed) (box 320) and prevents further operation of the printer (box 314). If the ID bit returns a satisfactory value, the controller 20 identifies the print cartridge as being from the correct family (a print cartridge that is operable in the chute in which it is installed) and continues with further operation of the printer (box 322).

Other information and contact areas and bumps, and combinations thereof, may be utilized to obtain the information of whether a print cartridge is installed and is operable in the chute. Additionally, the identification of whether a print cartridge is installed and is operable in the chute may be performed in a single step using only one value.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be only to be construed by the claims and the equivalents thereof.

What is claimed is:

1. A print cartridge comprising:

a cartridge body having a lower portion and a vertical wall;

a printhead coupled with the lower portion; and a contact array comprising a plurality of contact areas disposed on the vertical wall, the contact array being one selected from a group comprising a first contact array that has a first layout of contact area locations, and a second contact array that has a second layout of contact area locations, wherein a portion of the contact area locations of the first layout and a portion of the contact area locations of the second layout are the same, and another portion of the contact area locations of the first layout and another portion of the contact area locations of the second layout are different, and wherein the another portion of the contact area locations of the first layout and the another portion of the contact area locations of the second layout are coupled to provide identification information for the print cartridge.

2. The print cartridge of claim 1, wherein the another portion of the contact area locations of the first layout and the another portion of the contact area locations of the second layout include some of the sane contact are locations.

3. The print cartridge of claim 1, wherein the another portion of the contact area locations of the first layout and the another portion of the contact area locations of the second layout do not include some of the same contact area locations.

4. The print cartridge of claim 3, wherein the portion of the contact area locations of the first layout and the second layout is coupled to a component selected from the group consisting of temperature sense resistors, inactive contacts, and ground contacts.

5. The print cartridge of claim 1, wherein first layout includes a first pair of columnar arrays of contact areas and a second pair of columnar arrays of contact areas disposed on the vertical wall, the columnar arrays of each pair converging toward each other in a direction toward the lower portion of the cartridge body.

6. The print cartridge of claim 1, wherein the first layout and the second layout each has a width of less than about 12 mm.

7. The print cartridge of claim 1, wherein a number of contact areas in the portion of the first layout and the second layout are a same in number.

* * * * *

UNITED STATES PATENT AND TRADEMARK OFFICE

CERTIFICATE OF CORRECTION

PATENT NO. : 7,137,690 B2
APPLICATION NO. : 10/698088
DATED : November 21, 2006
INVENTOR(S) : Naoto Kawamura et al.

It is certified that error appears in the above-identified patent and that said Letters Patent is hereby corrected as shown below:

In column 12, line 28, in Claim 2, delete “sane” and insert -- same --, therefor.

In column 12, line 28, in Claim 2, delete “are” and insert -- area --, therefor.

Signed and Sealed this

Fourteenth Day of April, 2009

John Doll

JOHN DOLL
*Acting Director of the United States Patent and Trademark Office*